United States Patent [19]

Chanel

[11] Patent Number: 4,836,446

[45] Date of Patent: Jun. 6, 1989

[54] DEVICE AND METHOD FOR PRODUCING ARTIFICIAL SNOW

[76] Inventor: Pierre Chanel, "Le Chef-Lieu", Les Orres, Embrun, France, F-05200

[21] Appl. No.: 15,861

[22] PCT Filed: Mar. 26, 1986

[86] PCT No.: PCT/FR86/00104

§ 371 Date: Jan. 14, 1987

§ 102(e) Date: Jan. 14, 1987

[87] PCT Pub. No.: WO86/05864

PCT Pub. Date: Oct. 9, 1986

[30] Foreign Application Priority Data

Mar. 27, 1985 [FR] France ..... 85/04721

[51] Int. Cl.[4] ..... F25C 3/04

[52] U.S. Cl. ..... 239/2.2; 239/8; 239/14.2; 239/424

[58] Field of Search ..... 239/2.2, 14.2, 424, 239/555, 8, 433, 461; 137/70, 71, 72, 73

[56] References Cited

U.S. PATENT DOCUMENTS

| | | | |
|---|---|---|---|
| 2,676,471 | 4/1974 | Pierce | 62/172 |
| 2,968,164 | 1/1961 | Hanson | 239/2.2 |
| 3,072,346 | 1/1963 | Wahlin et al. | 239/463 |
| 3,494,559 | 2/1970 | Skinner | 239/2.2 |
| 3,703,991 | 11/1972 | Eustis et al. | |
| 3,716,190 | 2/1973 | Lindlof | 239/2.2 |
| 3,727,841 | 4/1973 | Hengesbach | 239/145 |
| 3,762,176 | 10/1973 | Coggins | 62/74 |
| 3,806,702 | 4/1974 | Spencer | 239/75 |
| 3,838,815 | 10/1974 | Rice | 239/14.2 |
| 3,948,442 | 4/1976 | Dewey | 239/2.2 |
| 4,105,161 | 8/1978 | Kircher et al. | 239/2.2 |
| 4,129,252 | 12/1978 | Pouring | 239/2.2 |
| 4,214,700 | 7/1980 | Vanderkelen et al. | 239/132.5 |
| 4,247,047 | 1/1981 | Schaming | 239/551 |
| 4,407,452 | 10/1983 | Born et al. | 239/132.5 |
| 4,473,186 | 9/1984 | Alperin | 239/8 |
| 4,475,688 | 10/1984 | Hodges | 239/2.2 |
| 4,545,529 | 10/1985 | Tropeano | 239/14.2 |
| 4,640,460 | 2/1987 | Franklin | 239/2.2 |
| 4,717,072 | 1/1988 | Girardin | 239/75 |

FOREIGN PATENT DOCUMENTS

| | | |
|---|---|---|
| 0004803 | 10/1979 | European Pat. Off. . |
| 2941052 | 3/1981 | Fed. Rep. of Germany . |
| 1444733 | 7/1966 | France . |
| 2304877 | 10/1976 | France . |
| 2371649 | 6/1978 | France . |

*Primary Examiner*—Andres Kashnikow
*Assistant Examiner*—Christopher G. Trainor
*Attorney, Agent, or Firm*—Sandler & Greenblum

[57] ABSTRACT

An apparatus and process for generating artificial snow. The apparatus includes a plurality of spray nozzles mounted on each of a plurality of spraying ramps. The spray nozzles are mounted at the outlet of a diffuser directly within the flow of air therefrom. At least one of the ramps include a plurality of spraying nozzles for introducing seeding particles. The seeding particles can be produced through hydropneumatic nozzles. Alternatively, the seeding particles can be produced by using a cryogenic liquid or by using an apparatus for dispersing snow particles accumulated in the vicinity of the snow producing apparatus. To obtain the greatest possible quantity of freezable water, the temperature, relative humidity, and wind speed and direction are sensed by a programmable controller which thereby controls the fan, water source, and pressure regulator to thereby optimize the quantity of snow produced. In addition, the apparatus and process include steps for sensing a property of the snow crystals as they are formed by the snow generator of the present invention. The property sensed can be the variation of the dielectric constant of the snow particles over a predetermined range of frequencies.

64 Claims, 4 Drawing Sheets

Im

DEVICE AND METHOD FOR PRODUCING ARTIFICIAL SNOW

The present invention relates to a process of manufacturing artificial snow. It relates equally to an apparatus designed for performing this process.

More precisely, the invention relates to industrial manufacturing processes of snow which allow for sufficiently substantial flows so as to be usable on ski slopes so as to compensate for a deficient natural snow fall.

Until now, known installations, whatever their principal of operation, utilize snow generators which operate along the length of the slopes themselves, either by moving them as needed, or by distributing them along the lengths of the portions to be snowed upon.

All of the snow generators which are generally known as "snow guns", are, in fact, sprayers which project into surrounding air, at subfreezing temperatures, fine droplets of water which must be frozen to obtain snow crystals or more precisely frost. All that is present is the exterior cold air and the water which directly exchange their heat, by heating of the air and evaporation of a portion of the droplets if it is not saturated.

For this process to be performed under good conditions, it is indispensible that the primary nucleation begin as rapidly as possible in the form of a maximum of seeds, such that the exchange of heat between the water and the air result in a secondary nucleation which is as complete as possible, even if the crystals formed contain more residual water than the natural snow. It is here that the type of snow generator utilized becomes a factor. Certain of them are pneumatic sprayers of high flow in which one utilizes thermodynamic cooling due to the expansion of the compressed air, to form at the level of the snow gun itself, a great quantity of seeds. The others utilize circular or toroidal sprayer ramps, with multiple nozzles; the primary nucleation is obtained, either with very fine hydraulic nozzles capable of creating seeds in sufficiently large quantity, or from small pneumatic sprayers which, in principle, rapidly favor the same formation. The fog of frost thus obtained is caught up in a substantial air flow created by a helicoidal fan placed upstream of the ramps and which likewise brings along the droplets of more or less substantial size, which will themselves frost beginning with the seeds. A process deriving from the preceeding principle makes it possible to obtain fine droplets by directing a high pressure water stream directly on the blades of a fan turning at a very high speed.

In a volume of air at a subfreezing temperature, at a certain degree of relative humidity, a defined mass of water droplets can freeze. The greater the volume of air which envelops the droplets, the greater will be the mass of water which can be frozen.

Two parameters become a factor: the power of the water jet which carries the water droplets nearer or further, and the feed of fresh air: wind or simply breeze from the hill, convection currents, supplying of air by every artificial mechanical means. The substantial quantity of heat which can be absorbed by evaporation, which depends on the degree of saturation of the air, can play, in the exchanges on the interior of the envelope of dispersion of the water stream, a considerable role, because each kilogram of water evaporated grossly absorbs more than 600 Kcal. The role of the evaporated water decreases when the dry temperature drops, but it is very important until about −8° C. Yet, it is between 0° C. and this temperature that the climactic statistics, in numerous countries where the necessity of making snow exists, show that the greatest possible number of hours of operation are concentrated. The yield of manufacturing installations of snow depend largely on the results obtained in this range.

Water pulverized into fine droplets can remain liquid very much below 0° C. This state of supercooling varies with the composition of the water. The purer it is (the case of droplets contained in clouds), the lower the effective freezing temperature. The natural waters used in the guns are not pure and contain, but in very variable quantities, glaciogenous nucleii which bring the primary nucleation temperature closer to the freezing temperature of 0° C., and this all the more the finer the droplets. For a given subfreezing temperature and relative humidity, the yield of a snow manufacturing installation depends therefore: on the diameters of the droplets, on their trajectories to the ground, on the supply of surrounding air, very largely on the quantity of seeds exiting the generator and finally on the quantity of glaciogenous nucleii.

The partial water vapor pressure tends towards saturation $e_w(t)$, with respect to liquid water. But there exists also a saturation vapor pressure with respect to the ice $e_i(t)$. Therefore, $e_w > e_i(t)$, with a maximum at −11.8° C., corresponding to 0.27 millibar. After a certain level of exchange by evaporation, the air can be in a state of subsaturation with respect to the liquid water and of super saturation with respect to the ice. The frost seeds increase in size to the detriment of the water droplets. This process, very substantial in the mechanism of natural snow precipitation, is much less in the case of that produced artificially. The distances, thus the available exchange times, are slight. It is before all the value of the relative humidity which is of great importance: the lower it is for a given dry subfreezing temperature, the more the yield of the snow makers increases.

The recent placement into service of original processes for pneumatic transport of natural or manufactured snow makes it possible to envision transferring at distances which can far exceed 1,000 meters, vast quantities of snow. The concentration of the production points is thus forseeable.

The present invention has particularly as an aim to propose a new process and a new type of snow generator manufacturing the snow in a "quarry" by favoring the control of all of the useful parameters, to obtain the geatest possible quantity of freezable water under predetermined conditions of dry temperature, relative humidity and speed of air displacement. The generator requires an automatic adjustment of all of the elements which condition its operation, by adaption of perfectly known and mastered apparatus. They integrate all of the atmospheric conditions as well as the characteristics of the water and the pulsed air.

On the contrary, the invention described proposes a particular adjustment which can take directly into account the level of water of manufactured crystals.

Figure 4:
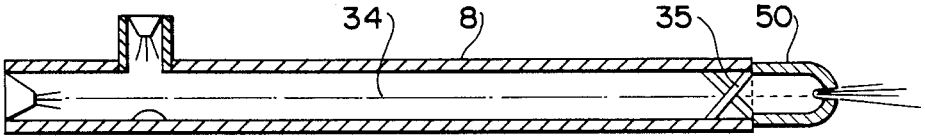

FIG. 4 schematically illustrates the principle of an air/water hydropneumatic sprayer.

Figure 5:
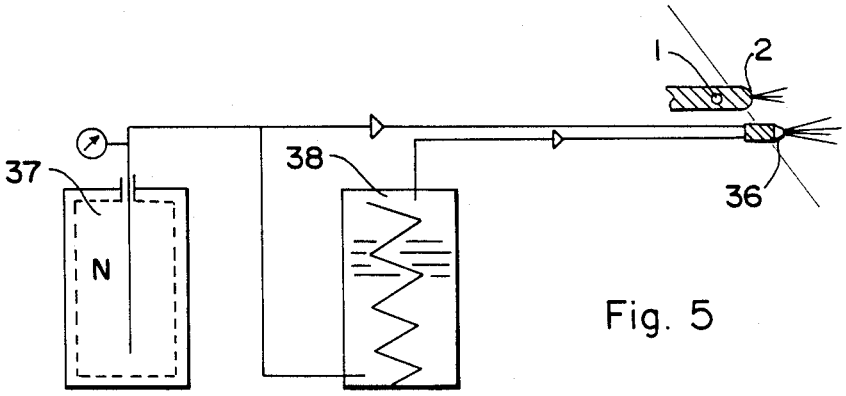

FIG. 5 illustrates the schematic of a pneumatic sprayer utilizing the liquid and gaseous nitrogen as well as its positioning with respect to the small granulometry nozzles.

Figure 6:
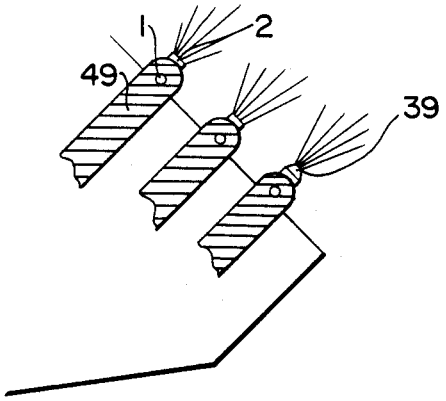

FIG. 6 illustrates the schematic of the liquid nitrogen nozzles and their positioning.

Figure 7:
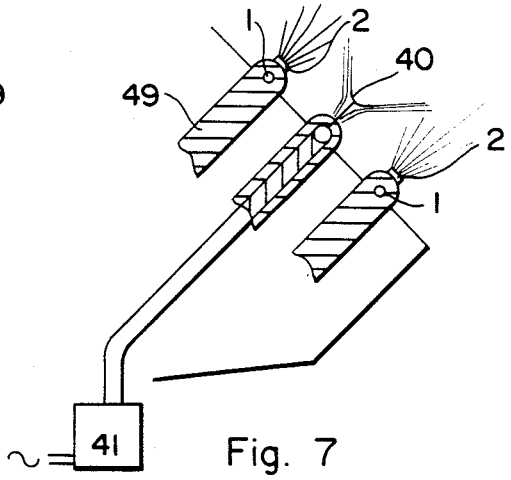

FIG. 7 illustrates the schematic of ultrasonic sprayers of liquid nitrogen and their positioning.

Figure 8:
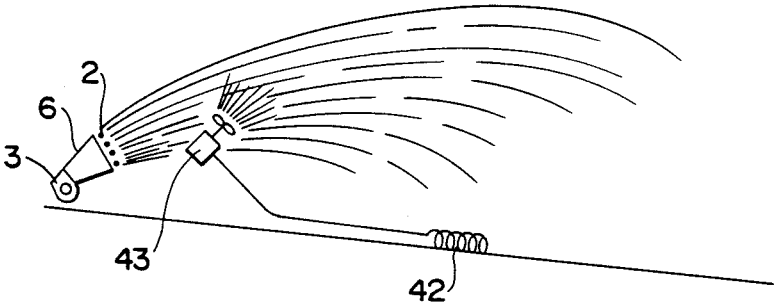

FIG. 8 illustrates, schematically, the use, for the seeding of atomized and dispersed snow crystals in the cloud of particles to be frozen.

Figure 9:
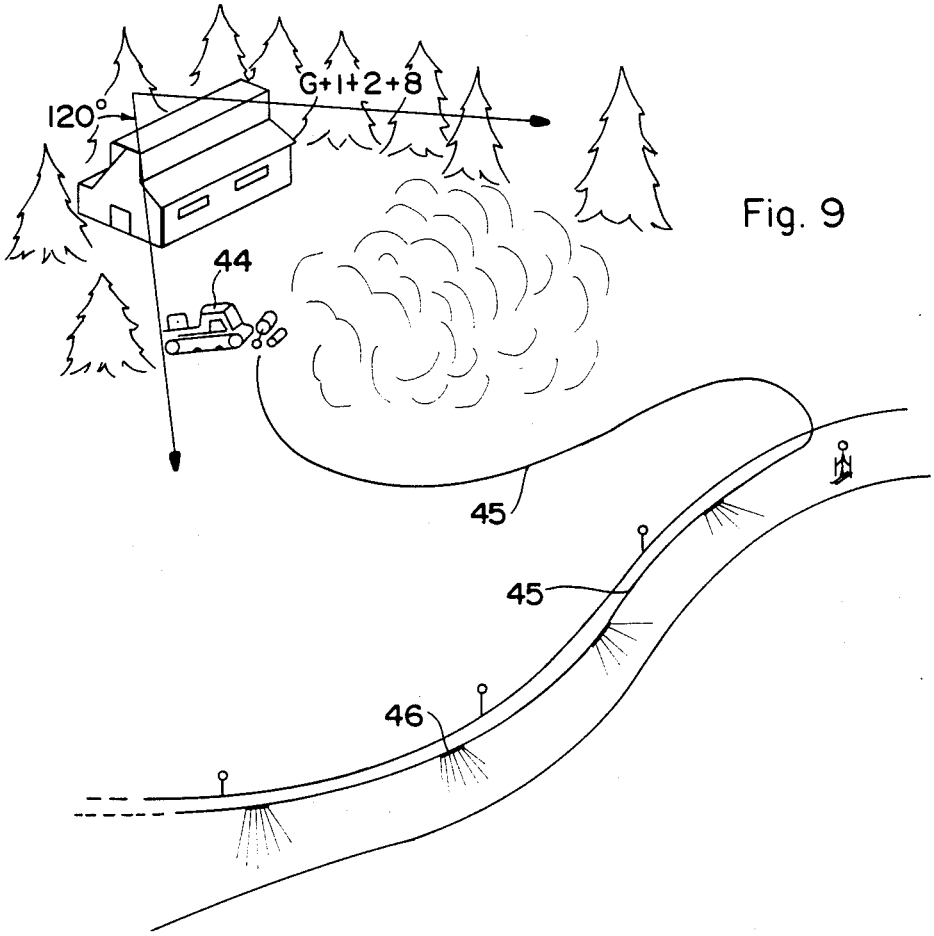

FIG. 9 shows, schematically, the use of a snow generator operating in a "quarry".

Figure 10:
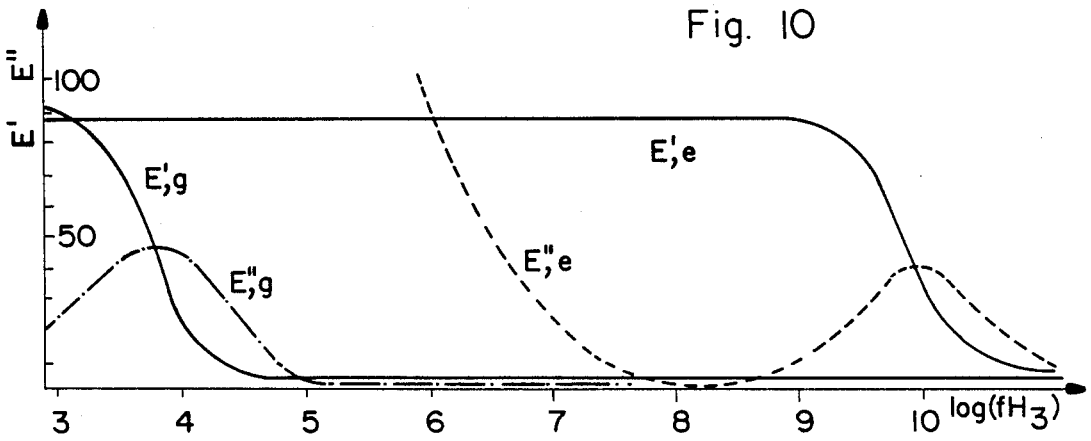

FIG. 10 illustrates the variation curves of the comparative dielectric constants of water and ice between $10^3$ and $10^{11}$Hz.

Figure 1:
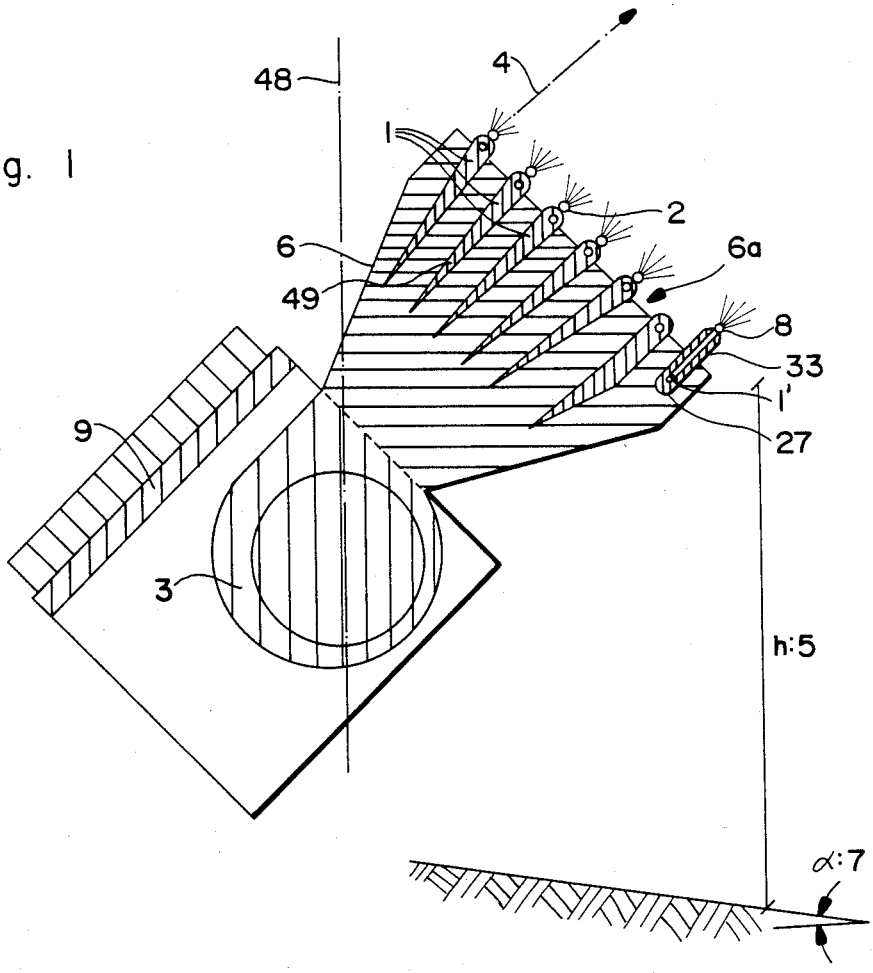
FIG. 1 is a side view, of a schematic nature, of the snow generator according to the invention.

The snow generator according to the invention schematically illustrated in FIG. 1 is based upon the principle of fan guns having multiple jets, by utilizing hydraulic sprayers and hydropneumatic sprayers furnishing a fog of water and frost particles caught up in a current of air produced by one or more powerful centrifugal fans.

The snow generator according to the invention comprises a plurality of tiered spraying ramps 1, 1' provided with spraying nozzles 2, 8 and positioned in parallel or approximately in parallel with a horizontal or quasihorizontal orientation. The particles ejected from these spraying nozzles at a certain velocity, are accelerated by a strong flow of air produced by one or more fans 3 positioned behind and uphill from spraying ramps 1, 1', these fans being preferably constituted by centrifugal fans, at variable speed or not, which allow for a regular distribution of the flow of air in the inlet section of diffuser 6 at the outlet of which are positioned the said spraying ramps and at an acceptable sound level.

The flow of fans 3 and the velocity of air are calculated simply so as to allow the particles, whatever their size, to follow a trajectory 4 of a sufficient length to obtain a maximum correct density of the snow manufactured. The flow of air from the fans can vary so as to better respond to substantial variations of the water pressures, its flow, of the types of nozzles in operation, of the direction and the velocity of displacement of the surrounding air. The trajectories of the particles also vary depending upon the height h5 of the diffuser 6 above the ground and the slope alpha of the natural ground 7.

The fine particles of water are furnished by a large number of hydraulic nozzles 2, while the seeds are produced by hydraulic sprayers 8 of a much lower number.

The spraying ramps 1, 1' provided with hydraulic nozzles 2 and hydropneumatic sprayers 8, respectively, form an assembly of ramps which preferably comprise, a single ramp 1' equipped with hydropneumatic sprayers and a plurality of ramps 1 equipped with hydraulic nozzles; ramp 1' provided with hydropneumatic sprayers being placed at the lower portion of the assembly, i.e., beneath ramps 1 allowing for the production of fine particles of water.

Ramp 1' provided with hydropneumatic sprayers 8, preferably has a length greater than that of ramps 1 provided with hydraulic nozzles 2, and extends beyond each side of the assembly constituted by these latter; the utility of this apparatus being explained in the course of the following description.

The assembly of spraying ramps 1, 1' is positioned at the outlet of diffuser 6 constituted by a casing open in front and having a transverse profile diverging in the direction of its rear outlet opening 6*a*.

The assembly constituted by ramps 1, 1' provided with hydraulic nozzles and hydropneumatic sprayers 8, and by the diffuser 6, is movable around a vertical axis 48, in a manner so as to have a variable orientation when the winds are too changeable in direction.

The special hydropneumatic sprayers 8 examples of which are described in the following description allow for the production of very fine and very numerous seeds which are likewise caught up in the form of a fog of frost by the current of air provided by fans 3. The air of the hydropneumatic sprayers 8 is furnished by compressors under pressures of 7–20 bars. The pressure of the water of the hydropneumatic sprayers varies with the conditions of use. As indicated previously, the hydraulic sprayers 8 are situated at the base of diffuser 6, along the entire length thereof. To increase the yield of the snow maker and the allow for the use of nozzles having very high output, which may or may not correlate with the increase in the pressures of the water, one can also place supplemental hydropneumatic sprayers above diffuser 6 or on the interior of its outlet surface, essentially for low temperature (lower than −12° C. approximately.

The spraying ramps are positioned in aerodynamic flaps 33 and 49.

These flaps comprise a frontal end which is rounded and they are placed within diffuser 6; they participate in the regulation and distribution of the flow of air caused by each fan 3.

Figure 3:
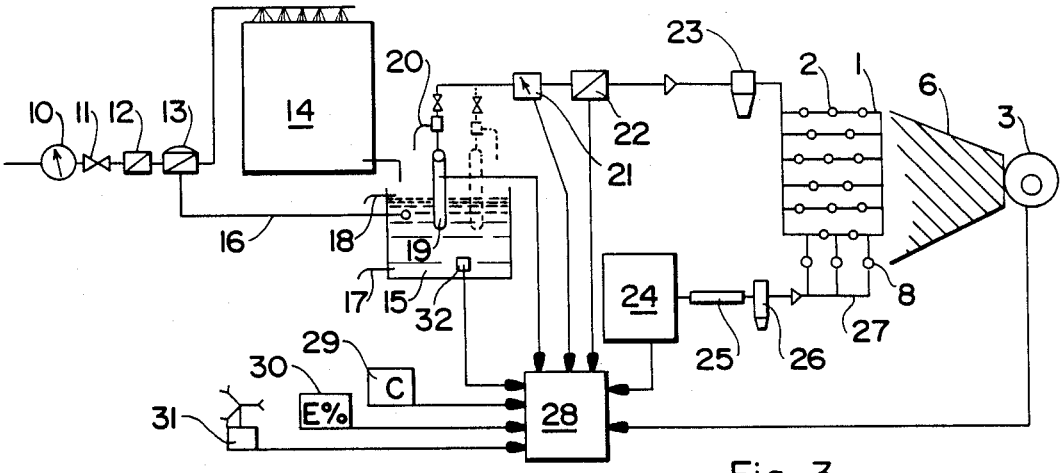
FIG. 3 shows the schematic drawing of the installation assembly: feed, production, automation.

The water to be frozen can be cooled in air/water exchangers 9 or, preferably, in open circuit cooling towers 14 (FIG. 3).

The manufacture of the snow in a "quarry", i.e., in a fixed place, makes it possible to be free of geometric and weight constraints which presently limit the size of the generators, all movable or multiple. The circular or toroidal ramps of the known fan guns being replaced, according to the invention, by horizontal ramps, the functions allocated to each type of nozzle or group of nozzles, can be differentiated. Thus, at the outlet of the apparatus, one can have stratas of droplets, each playing one or more specific roles on which the total yield of the installation depends. This result is obtained by the use of different types of nozzles with variable intake. The finer the granulometry of the droplets of each type of sprayer or hydraulic nozzle, the more their role consists of increasing, as closely as possible to the outlet of the apparatus, the seeds by coalescence with the seeds from the hydropneumatic sprayers, but also to produce cold by evaporation as a function of the relative humidity of the air.

Figure 2:
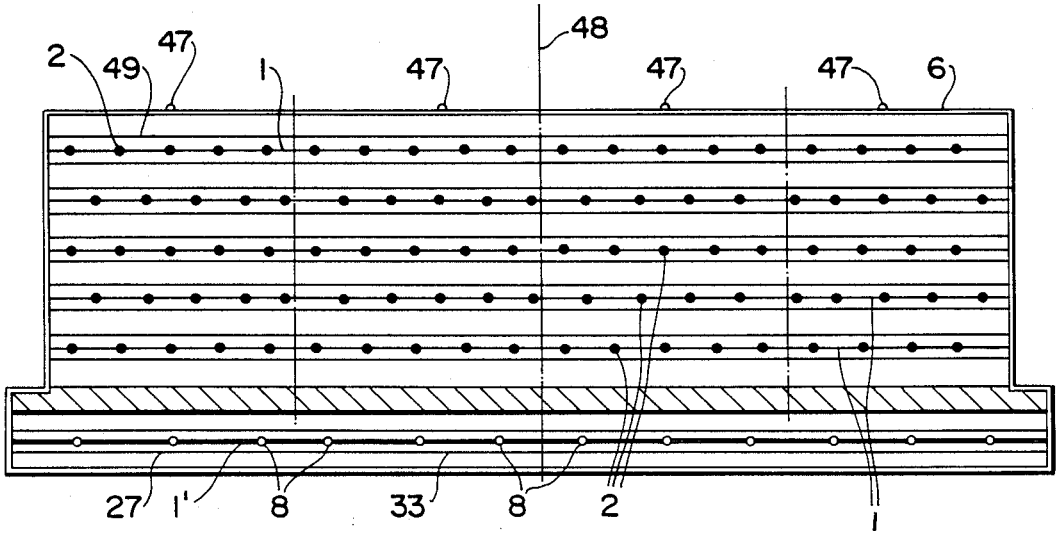
FIG. 2 shows schematically the disposition of the feed ramps of the nozzles and of the hydropneumatic sprayers of this generator.

FIG. 2 illustrates, schematically, the staggered distribution of hydraulic nozzles 2 and hydropneumatic sprayers 8, on the surface of the outlet of diffuser 6. The relative spacing of the nozzles, on the order of 15–25 cm, and their staggered arrangement, makes it possible to bring about a substantial exchange of air volume and to limit the coalescence of the droplets, at least on the first portion of their trajectory where they will be able to cool to their freezing temperature but also evaporate, particularly the smaller ones. It will be remembered, as a rough estimate, that a gram of evaporated water lowers by 1.6° C. the temperature of a cubic meter of air while this temperature rises 0.23° C. when this same gram of water goes into the solid state.

The installation according to the invention can be equipped with automation apparatus, known in itself, by virtue of which it is possible to select the number and the type of snow generator nozzles which is desirable to be placed in service, as a function of the temperature. Thus, the more the wet temperature drops, the more the apparatus puts into service, automatically, high flow sprayers with a corresponding increase in the granulometry of the droplets.

FIG. 3 shows a schematic of the operation of the snow generator assembly. The water arrives at a flow meter 10 and goes through an assembly comprising a valve 11 and a filter 12. After this assembly, an altimetric faucet 13 regulated on the level of a tank 15 by a tap 16, feeds a cooler 14 which empties into a tank 15. This one is provided with a draining outlet 17 and a spillway 18. One or more high pressure pumps 19 take the water from tank 15 to send it into spraying ramps 1 across a spillway 20, a flow meter 21, a pressure limiter 22 and a filter 23. The different diameter nozzles 2 are distributed on ramps 1. The same network furnishes the water of the hydropneumatic sprayers 8. The air of the sprayers is furnished at pressures between 7 and 20 bars by a compressor 24 provided with an assembly comprising a cooler 25 and a decanter 26 and which feeds the ramp 27 to which the sprayers are connected.

The centrifugal fan 3 furnishes the propulsion air across the diffuser assembly 6.

A regulation assembly equipped with a programmable automation 28 receives the following information: dry temperature 29, relative humidity 30, speed of displacement and direction of surrounding air 31, temperature of the water to be frozen 32. The information serves to pilot compressor 24, the fan, the water pumps 19 and the pressure limiter 22.

The flow meter 21 controls the proper operation of the nozzles 2 and of the hydropneumatic sprayers 8.

FIG. 2 illustrates that the ramp and the diffuser flap system 33 of the hydropneumatic sprayers 8 extend beyond each side of the principle diffuser 6, such that the fog of seeds well covers the maximum spread of the dispersions of droplets produced by the nozzles 2, whatever the direction of displacement of the surrounding air, within the limits fixed for the proper operation of the apparatus: approximately 60°, on both sides of the axis of the apparatus. FIG. 2 also illustrates that the generator can preferably be composed of juxtaposed elements formed of standard modules 47 so as to increase, at will, its production capacity.

FIG. 4 shows a schematic of a hydropneumatic sprayer 8 of compressed air with mixing on the interior, beginning at the rear of the apparatus, near the air and water sprayers. This material is characterized by a very long mixing chamber 34, for example of 150–200 mm for a diameter of 10–12 mm. A winged helix 35 of the type which are currently utilized on solid conical hydraulic nozzles, is placed ahead of a flat jet nozzle 50 constituting the end of the sprayer and assuring a rectangular distribution of the particles.

The invention anticipates the replacement of the air/-water sprayers of this type, by sprayers utilizing a cryogenic liquid, such as nitrogen, or by the dispersion, directly in the fog, of fine particles of snow taken from the vicinity of the snow generator.

FIG. 5 illustrates the schematic of a pneumatic sprayer 36 functioning with nitrogen in the liquid and gas form. The nitrogen is stored in a cannister 37 in the proximity of the apparatus. The gaseous nitrogen is obtained from this cannister by means of an exchanger 38. The pressures of the liquid and gaseous phases at the inlet to the sprayers 36 are practically the same. These are likewise placed at the base of the apparatus, horizontally but much closer than the hydropneumatic sprayers 8, of the first hydraulic ramps which will be of very fine granulometry.

FIG. 6 traces the installation schematic of pressurized liquid nitrogen nozzles 39, in the proximity of the first hydraulic nozzles of very fine granulometry.

FIG. 7 shows the schematic of ultrasound liquid nitrogen sprayers under very low pressure 40 operating with the aid of an oscillator 41 vibrating at frequencies between 20 and 100 Khz. The ramp of sprayers 40 is, in this case, preferably placed between two ramps 1 of hydraulic nozzles 2 having very fine granulometries.

FIG. 8 shows, schematically, the removal apparatus 42 and dispersion apparatus 43 of snow crystals (natural or artificial) on the interior of the water fog leaving nozzles 2 to break the supercooling. To avoid excessive snow consumption, it is necessary to obtain a very extensive atomization and an efficient dispersion of the crystals. This result is obtained by means of fans 43 which constitute the dispersion apparatus, turning at very high speed.

In all of the systems described above, the protection, against freezing, of the water pipes and their accessories, as well as all of the elements of the water of the compressed air network where there is the possibility of expansion (in normal operation or upon stopping of the installation), is assured by an insulating envelope and a layout provided with self-regulating electrical elements at a temperature in the vicinity of +5° C. Upon stopping the installation, all of the exterior circuits empty, for safety, with the possible addition of automatically activated three-way motorized fans. Ramp, 1, 1', described as horizontal, present, in fact in a preferred manner, so as to facilitate this emptying, a very slight slope while remaining parallel to one another.

FIG. 9 shows, schematically, the use which can be made of a fixed position snow generator according to the invention, so as to allow for delivering snow to a ski slope. The manufacture of the snow in a quarry, at a site selected for its specific qualities and without any concern for the environment, makes it possible to obtain a very high yield due to the possibility of taking into account, in the programming of operation, all of the variables concerned, but with a single value for each amongst them. The generator is completed by a removal system of the snow 44 and for its transfer under pressure into a flexible or rigid pipe 45 which makes it possible to distribute it on the slope along openings 46 properly distributed along the length of the layout. The "production" and "transport" functions of the snow are totally independent and can therefore each adopt different and variable schedules.

In the case where it is not possible to have at one's disposition an implantation site offering a maximum number of hours of operation with winds or breezes which maintain themselves in an acceptable operation cone of approximately 120°, the ramp assembly 1 and diffuser 6 can be movable around a vertical axis 48, as previously indicated.

It is possible to utilize, to regulate the automatic operation of the generator, the direct measure of the content in liquid (TEL) of the crystals of snow manufactured, in the course of their production, on the ground or during their trajectories. The process utilizes the variations of the electrical properties of the water in the solid or liquid phase, essentially of its dielectric constant. One can analyze in the formula: $\epsilon=\epsilon'-j\epsilon''$, either the fluctuations of $\epsilon'$ (relative permittivity), or $\epsilon''$ (loss factor, characterizing absorption). The frequencies utilized, depending on the measurement types, will be less than 1 GHz or greater (microwave range).

FIG. 10 gives, by way of example, in the range of radio frequencies, the variations and the substantial differences of relative permittivity of the water $\epsilon'e$ and of the ice $\epsilon'g$, as well as the loss factors of the water $\epsilon''e$ and of the ice $\epsilon''g$. The wet snow which is of interest will thus have its electrical properties vary considerably with its TEL.

It must be noted that the measure of the TEL of the crystals is not comparable to the measure of the volumetric mass of the manufactured snow. There is no close correspondence between these two pieces of information except where the crystals remain identical in their shapes, their sizes, their structures and their distribution. Yet, it is known that this is not the case because many of the parameters in question become modified as a function of the types of nozzles and their flow, pressures and temperatures of the water and of the air, etc.

I claim:

1. A snow-making apparatus for forming snow crystals comprising:

a diffuser housing;

a fan operatively associated with said diffuser housing for generating a flow of air therethrough;

a plurality of spraying ramps positioned substantially parallel to each other and mounted to said diffuser housing and within said flow of air;

a plurality of sprayers mounted on each of said spraying ramps including at least one hydraulic sprayer mounted on at least one of said spraying ramps and including at least one seeding sprayer mounted on at least one of said spraying ramps; and said sprayers spaced apart a predetermined amount.

2. A snow-making apparatus according to claim 1, wherein said predetermined amount is within the range of approximately 15 to 25 centimeters.

3. A snow-making apparatus according to claim 1, wherein said plurality of sprayers of at least one of said plurality of spraying ramps is staggered relative to said plurality of sprayers of another of said plurality of spraying ramps.

4. A snow-making apparatus according to claim 1, wherein said plurality of sprayers of each of said plurality of spraying ramps is staggered relative to each respective adjacent plurality of sprayers of said plurality of spraying ramps.

5. A snow-making apparatus according to claim 1, wherein at least one of said plurality of sprayers mounted on at least one of said plurality of spraying ramps are hydraulic sprayers, and wherein at least one of said plurality of sprayers mounted on at least one of said spraying ramps are seeding sprayers.

6. A snow-making apparatus according to claim 1, wherein said at least one of said plurality of spraying ramps on which said at least one seeding sprayer is mounted is positioned beneath said at least one of said spraying ramps on which said at least one hydraulic sprayer is mounted.

7. A snow-making apparatus according to claim 6, wherein said at least one of said plurality of spraying ramps on which said at least one seeding sensor is mounted has a length greater than said at least one of said plurality of spraying ramps on which said at least one hydraulic sprayer is mounted.

8. A snow-making apparatus according to claim 1, wherein each of said plurality of spraying ramps is inclined from horizontal to thereby facilitate its emptying.

9. A snow-making apparatus according to claim 1, further comprising a plurality of flaps having rounded ends, said plurality of flaps mounted within said diffuser housing, wherein each of said plurality of spraying ramps is mounted on a respective flap.

10. A snow-making apparatus according to claim 1, wherein said fan is a centrifugal fan.

11. A snow-making apparatus according to claim 1, wherein said diffuser housing and all of said plurality of spraying ramps comprise an assembly, and wherein said assembly is rotatably mounted about a substantially vertical axis.

12. A snow-making apparatus according to claim 5, wherein each of said at least one seeding sprayer comprises an air/water mixing chamber, a helical section downstream thereof, and a semi-spherical nozzle having a flat jet.

13. A snow-making apparatus according to claim 12, wherein said mixing chamber has a predetermined length and a predetermined diameter, and wherein the ratio of said predetermined length to said predetermined diameter is greater than eight.

14. A snow-making apparatus according to claim 13, wherein said predetermined length is within the range of approximately 150–200 millimeters and said predetermined diameter is within the range of approximately 10–12 millimeters.

15. A snow-making apparatus according to claim 1, further comprising a plurality of adjacent modular units, each of said adjacent modular units comprising its own diffuser housing.

16. A snow making apparatus according to claim 1, wherein said diffuser housing comprises an outlet opening and said plurality of spraying ramps is mounted proximate said opening.

17. A snow-making apparatus according to claim 16, wherein said diffuser housing diverges from said inlet opening to an outlet opening.

18. A snow-making apparatus according to claim 1, further comprising a source of cryogenic fluid, and wherein said at least one seeding sensor is connected to said source of cryogenic fluid.

19. A snow-making apparatus according to claim 18, wherein said cryogenic fluid is a liquid.

20. A snow-making apparatus according to claim 19, wherein said cryogenic fluid is liquid nitrogen.

21. A snow-making apparatus according to claim 19, wherein said at least one of said plurality of sprayers which is connected to said source of cryogenic fluid further comprises ultrasonic vibrators for atomizing said cryogenic liquid.

22. A snow-making apparatus according to claim 21, wherein said at least one of said plurality of sprayers which further comprises ultrasonic vibrators is mounted on one of said plurality of ramps above at least another of said plurality of ramps.

23. A snow-making apparatus according to claim 1, further comprising means for measuring the liquid water content of the snow crystals formed by said snow-making apparatus.

24. A snow-making apparatus according to claim 23, wherein said means for measuring is arranged to measure the liquid water content of snow crystals as they are generated by said snow-making apparatus.

25. A snow-making apparatus according to claim 24, wherein said means for measuring is arranged to measure the liquid water content of snow crystals during the course of their trajectories as they are expelled from said diffuser housing.

26. A snow-making apparatus according to claim 23, wherein said means for measuring comprises means for detecting variations of electrical properties of said snow crystals.

27. A snow-making apparatus according to claim 26, wherein said means for measuring further comprises means for detecting the value of the dielectric constant E of said snow crystals.

28. A snow-making apparatus of claim 27, wherein said means for detecting comprises means for detecting the value of the dielectric constant E of said snow crystals over a range of frequencies in the microwave or radio frequency range.

29. A snow-making apparatus of claim 27, wherein said dielectric constant E is defined as $E'-jE''$, where $E'$ is the relative permittivity, $E''$ is the loss factor which is a function of absorption, and j is a constant, and wherein said means for detecting comprises means for detecting the value of $E'$ or $E''$ of said snow crystals.

30. A snow-making apparatus according to claim 1, further comprising:

a source of water;

first connecting means for connecting said source of water to at least one of said plurality of sprayers;

regulating means for regulating the flow of water through said first connecting means;

sensing means for sensing at least the condition of the atmosphere;

control means operatively associated with said sensing means for controlling said regulating means as a function of data received from said sensing means.

31. A snow-making apparatus according to claim 30, wherein said sensing means further comprises means for sensing at least one of: air speed and direction; relatively humidity; and air temperature.

32. A snow-making apparatus according to claim 30, wherein said sensing means comprises a water temperature sensing means for sensing the temperature of said source of water.

33. A snow-making apparatus according to claim 30, wherein said control means further comprises means to control the operation of said fan.

34. A snow-making apparatus according to claim 30, further comprising:

a source of compressed gas;

second connecting means for connecting said source of compressed gas to at least another of said plurality of sprayers; and wherein said control means further controls the supply of said source of compressed gas to said at least another of said plurality of sprayers.

35. A snow-making apparatus according to claim 23, further comprising:

a source of fluid operatively associated with at least one of said plurality of sprayers; and control means operatively associated with said means for measuring the liquid water content of the snow crystals formed by said snow-making apparatus to control at least one of said source of fluid and said fan.

36. A snow-making apparatus according to claim 1 further comprising:

means for measuring or sensing a property of snow crystals as they are formed by said snow-making apparatus;

a source of fluid operatively associated with at least one of said plurality of sprayers; and control means operatively associated with said means for measuring or sensing to control at least one of said source of fluid and said fan.

37. A snow-making apparatus according to claim, wherein said at least one seeding sprayer comprises a hydropneumatic sprayer.

38. A snow-making apparatus according to claim 1, wherein said at least one seeding sprayer is adapted to spray a cryogenic fluid.

39. A snow-making apparatus according to claim 1, wherein said at least one seeding sprayer is adapted to spray snow crystals.

40. A snow-making apparatus according to claim 16, wherein said plurality of sprayers are positioned proximate a single plane.

41. A snow-making apparatus according to claim 26, wherein said means for detecting variations of electrical properties further comprises means for detecting variations of electrical properties in alternating current.

42. A process for making snow comprising:

ejecting a mist of water particles from a snow generator to produce snow crystals;

sensing or measuring a property of said snow crystals as they are produced by said snow generator; and controlling said snow generator as a function of said step of sensing or measuring.

43. A process according to claim 42, wherein said step of sensing or measuring is performed during the course of the trajectories of said snow crystals as they are ejected from said snow generator.

44. A process according to claim 42, wherein said step of sensing or measuring comprises measuring the liquid water content of said snow crystals produced by said snow generator.

45. A process according to claim 44, wherein said step of measuring the liquid water content of said snow crystals comprises detecting variations of electrical properties of said snow crystals.

46. A process according to claim 44, wherein said step of measuring the liquid water content of said snow crystals comprises detecting the value of the dielectric constant E of said snow crystals.

47. A process according to claim 44, wherein said step of measuring the liquid water content of said snow crystals comprises detecting the value of the dielectric constant E of said snow crystals over a range of frequencies in the microwave or radio frequency range.

48. A process according to claim 44, wherein said step of measuring the liquid water content of said snow crystals comprises detecting the value of the relative permittivity or the loss factor of said snow crystals.

49. A process according to claim 42, wherein said snow generator further comprises a plurality of sprayers; at least one source of fluid connected to said plurality of sprayers; means for regulating the supply of said at least one source of fluid; means for regulating the pressure of said source of fluid; a fan for generating a flow of air; wherein said step of controlling further comprises controlling at least one of said means for regulating the supply, said means for regulating the pressure, and said fan, as a function of said step of sensing or measuring a property of said snow crystals.

50. A process for making snow comprising:

generating a flow of air having a predetermined cross-sectional size and shape;

ejecting a mist of water particles from a plurality of substantially parallel ramps, each of said ramps including a plurality of sprayers located within said flow of air, wherein said sprayers of adjacent ramps are staggered relative to each other; and ejecting seeding particles from a plurality of sprayers located within said flow of air.

51. A process according to claim 50, wherein said step of generating a flow of air further comprises generating a flow of air having a generally rectangular cross-sectional shape.

52. A process for making snow comprising:

generating a flow of air having a predetermined cross-sectional size and shape;

ejecting a mist of water particles from a plurality of sprayers located within said flow of air; and ejecting seeding particles for the production of snow crystals, from a further plurality of sprayers, wherein both of said plurality of sprayers are supported on a plurality of parallel ramps located within said flow of air.

53. A process according to claim 52, wherein said step of ejecting seeding particles is performed by hydro-pneumatic sprayers.

54. A process according to claim 52, wherein said step of ejecting seeding particles further comprises ejecting said seeds in a pattern having a width greater than the width of the pattern in which the mist of water particles is ejected.

55. A process according to claim 52, wherein said step of ejecting seeding particles further comprises the step of ejecting a cryogenic liquid into said flow of air.

56. A process according to claim 52, wherein said step of ejecting seeding particles further comprises the step of ejecting fine particles of snow.

57. A process for making snow according to claim 50, wherein said water particles and said seeding particles are ejected from a location proximate a single plane at a diffuser outlet.

58. A snow-making apparatus comprising:

a diffuser housing;

a fan operatively associated with said diffuser housing for generating a flow of air therethrough;

a plurality of spraying ramps mounted to said diffuser housing and within said flow of air;

a plurality of sprayers mounted on each of said spraying ramps, said plurality of sprayers spaced apart a predetermined amount;

means for removing snow crystals from a source of artificial or natural crystals;

means for atomizing and dispersing said snow crystals in said flow of air generated by said fan; and means for transferring said snow crystals from said means for removing to said means for atomizing and dispersing.

59. A snow-making apparatus comprising:

a diffuser housing;

a fan operatively associated with said diffuser housing for generating a flow of air therethrough;

a plurality of spraying ramps mounted to said diffuser housing and within said flow of air; and a plurality of sprayers mounted on said spraying ramps, said plurality of sprayers including seeding sprayers and hydraulic sprayers, said plurality of sprayers being spaced apart a predetermined amount.

60. A snow-making apparatus according to claim 59, wherein said plurality of spraying ramps are substantially parallel to each other.

61. A snow-making apparatus according to claim 60, wherein said plurality of spraying ramps are substantially horizontal.

62. A snow-making apparatus according to claim 59, wherein said plurality of sprayers comprise at least one plurality of hydraulic sprayers on at least one of said plurality of spraying ramps and at least one plurality of seeding sprayers on at least one of said plurality of spraying ramps.

63. A snow-making apparatus according to claim 59, wherein said seeding sprayers and said hydraulic sprayers are positioned in substantially a single plane.

64. A snow-making apparatus according to claim 63, wherein said diffuser housing has an outlet and wherein said single plane is proximate said outlet.

* * * * *

UNITED STATES PATENT AND TRADEMARK OFFICE

CERTIFICATE OF CORRECTION

PATENT NO. : 4,836,446

DATED : June 6, 1989

INVENTOR(S) : P. CHANEL

It is certified that error appears in the above-identified patent and that said Letters Patent is hereby corrected as shown below:

At column 2, line 27, change "ew>ei (t)" to ——ew(t)>ei(t)——.

At column 8, line 1, change "sensor" to ——sprayer——.

At column 8, line 49, change "sensor" to ——sprayer——.

At column 9, line 44, change "relatively" to ——relative——.

At column 10, line 13, change "claim" to ——claim 1——.

At column 4, line 21, change "the" to ——to—— before "allow".

At column 4, lines 26/27, change "approximately." to --approximately).-- .

Signed and Sealed this

Fifteenth Day of October, 1991

*Attest:*

*Attesting Officer*

HARRY F. MANBECK, JR.

*Commissioner of Patents and Trademarks*